United States Patent [19]

Honda et al.

[11] Patent Number: 4,941,019

[45] Date of Patent: Jul. 10, 1990

[54] APPARATUS FOR DEVELOPING ELECTROSTATIC LATENT IMAGE

[75] Inventors: Takao Honda, Kawasaki; Yoshiaki Kobayashi, Yokohama, both of Japan

[73] Assignee: Canon Kabushiki Kaisha, Tokyo, Japan

[21] Appl. No.: 337,655

[22] Filed: Apr. 13, 1989

[30] Foreign Application Priority Data

Apr. 15, 1988 [JP] Japan ..... 63-091266
Jun. 24, 1988 [JP] Japan ..... 63-154954

[51] Int. Cl.[5] ..... G03G 15/09

[52] U.S. Cl. ..... 355/251; 355/245; 118/658

[58] Field of Search ..... 355/251, 245, 250; 118/658, 656, 657; 430/122

[56] References Cited

U.S. PATENT DOCUMENTS 4,334,772 6/1982 Suzuki ..... 355/251
4,370,049 1/1983 Kuge et al. ..... 355/251
4,422,405 12/1983 Kasahara et al. ..... 118/658
4,557,992 12/1985 Haneda et al. ..... 430/122
4,585,326 4/1986 Okamoto et al. ..... 355/251
4,676,191 6/1987 Kojima et al. ..... 118/657
4,766,458 8/1988 Oka et al. ..... 118/657 X
4,792,225 12/1988 Itaya ..... 355/251
4,799,086 1/1989 Mori ..... 355/251

*Primary Examiner*—A. C. Prescott
*Attorney, Agent, or Firm*—Fitzpatrick, Cella, Harper & Scinto

[57] ABSTRACT

A developing apparatus wherein a developer is carried on a rotatable developing sleeve having a magnet therein into a developing zone where the sleeve and a image bearing member carrying an image to be developed is opposed to each other. A tangential component of a magnetic field formed on the sleeve surface by a developing magnetic pole disposed faced to the developing zone changes with an angular position on the sleeve. A change rate thereof has a local maximum or local minimum not less than 30 Gausses per degree. By this, "tails" and "scattered spots" are prevented from being produced on a developed image.

13 Claims, 6 Drawing Sheets

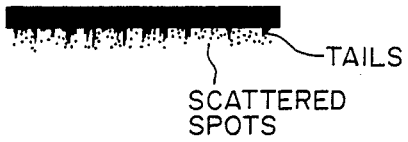
FIG. 1A
PRIOR ART
FIG. 1B
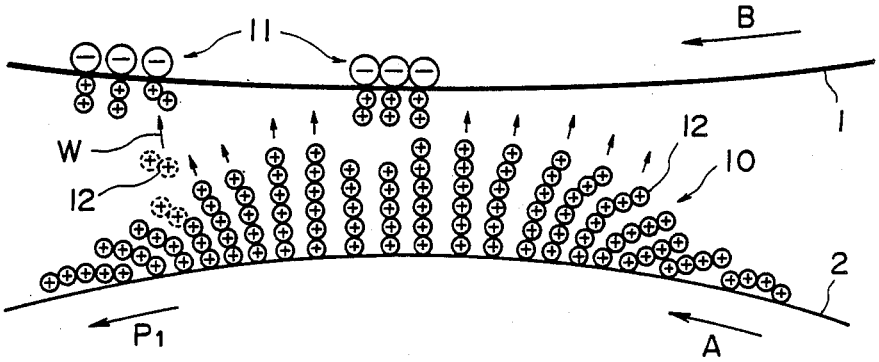
FIG. 2A
PRIOR ART
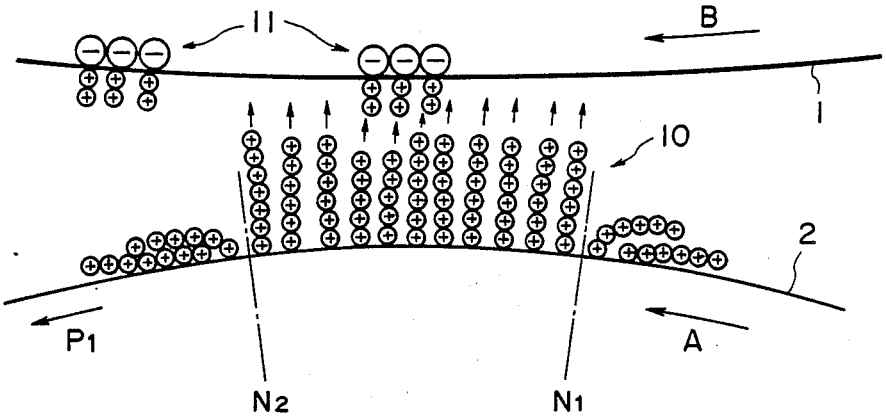
FIG. 2B

APPARATUS FOR DEVELOPING ELECTROSTATIC LATENT IMAGE

FIELD OF THE INVENTION AND RELATED ART

The present invention relates to a developing device for developing electrostatic latent images, more particularly to the developing device wherein a developer is carried on a developer carrying member in the form of a layer having a thickness smaller than the clearance between an image bearing member and the developer carrying member is faced to the image bearing member to develop the latent image.

Conventionally, the developer carrying member is in the form of a non-magnetic rotatable member which is disposed opposed to an outer periphery of the image bearing member and which carries on its outer periphery the developer having a magnetic property. In the developing zone containing the portion where the image bearing member and the rotatable member are closest, the developer is transferred from the rotatable member to the image bearing member, so that the electrostatic latent image on the image bearing member is developed.

As for a means for magnetically attracting or retaining the developer on the surface of the rotatable member, a magnet having plural magnetic poles is fixed within the rotatable member. One of the magnetic poles is disposed at a position within the developing zone and adjacent the closest position between the image bearing member and the rotatable member. The magnetization is such that a perpendicular component of the magnetic field (the component of the magnetic field perpendicular to the surface of the rotatable member) provides the maximum flux density point at or adjacent the center of the developing zone. The perpendicular magnetic field component magnetically confines the developer on the outer periphery of the rotatable member in the developing zone to form a brush so as to transfer the developer to the image bearing member.

The magnetic flux density of the perpendicular component gradually decreases toward the opposite ends of the developing zone, and correspondingly, the tangential component of the magnetic field (the component of the magnetic field in the tangential direction of the outer periphery of the rotatable member) gradually increases in its density. As a result, the brush of the developer inclines toward the surface of the rotatable member away from the center of the developing zone. Therefore, the image developed in such a marginal region involves various problems.

Referring to FIG. 1A, "tails", for example, are produced, the developer extends in the form of lines from an image in the direction opposite to the movement of the image bearing member. Another example is production of "scattered spots" which are produced by worsened tails, by which the developer particles are scattered around the image.

Referring to FIG. 2A, the brush of the developer is shown in an enlarged scale. In this figure, the developer 10 is carried on the developing sleeve 2 functioning as the developer carrying member. On the photosensitive drum 1 functioning as the image bearing member, an electrostatic latent image (shown as negative signs indicated by a reference numeral 11) is carried. In the portion where the photosensitive drum 1 and the developing sleeve 2 are closest (in the example of the figure, the center of the developing zone), the developer 10 in the form of a brush on the developing sleeve 2 is electrostatically attracted to the photosensitive drum 1 and is moved thereto. However, in the position away from the central portion of the developing zone to the opposite ends, the brush is gradually inclined under the influence of the tangential component of the magnetic field. This tendency appears remarkably at the opposite end portions of the developing zone, as indicated by a reference numeral 12. For example, at the left portion of the developing zone in FIG. 2A, a part of the developer 10 brush inclined toward the developing sleeve 2 is attracted electrostatically to the photosensitive drum 1 in the direction indicated by an arrow W, although the clearance between the photosensitive drum 1 and the developing sleeve 2 is increasing. Therefore, on the photosensitive drum 1 which is rotating, the developer 10 is deviated in the direction opposite to the direction of the photosensitive drum movement D. The deviation is contributable to the above-described tails extending backwardly on the copied image. A part of the brush is broken during the transferring through the clearance between the image bearing member and the developer carrying member or at the time of abutment to the photosensitive drum, with the result of the scattered spots.

SUMMARY OF THE INVENTION

Accordingly, it is a principal object of the present invention to provide a developing apparatus capable of forming images having a good quality.

It is another object of the present invention to provide a developing apparatus which is substantially free from "tails" and "scattered spots" in the resultant image.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1A shows a developed image in a conventional developing apparatus.

FIG. 1B shows a developed image provided by a developing apparatus according to the present invention.

FIG. 2A is a sectional view of a conventional developing apparatus, illustrating behavior of the developer.

FIG. 2B illustrates behavior of the developer according to the present invention.

DESCRIPTION OF THE PREFERRED EMBODIMENTS

Figure 3:
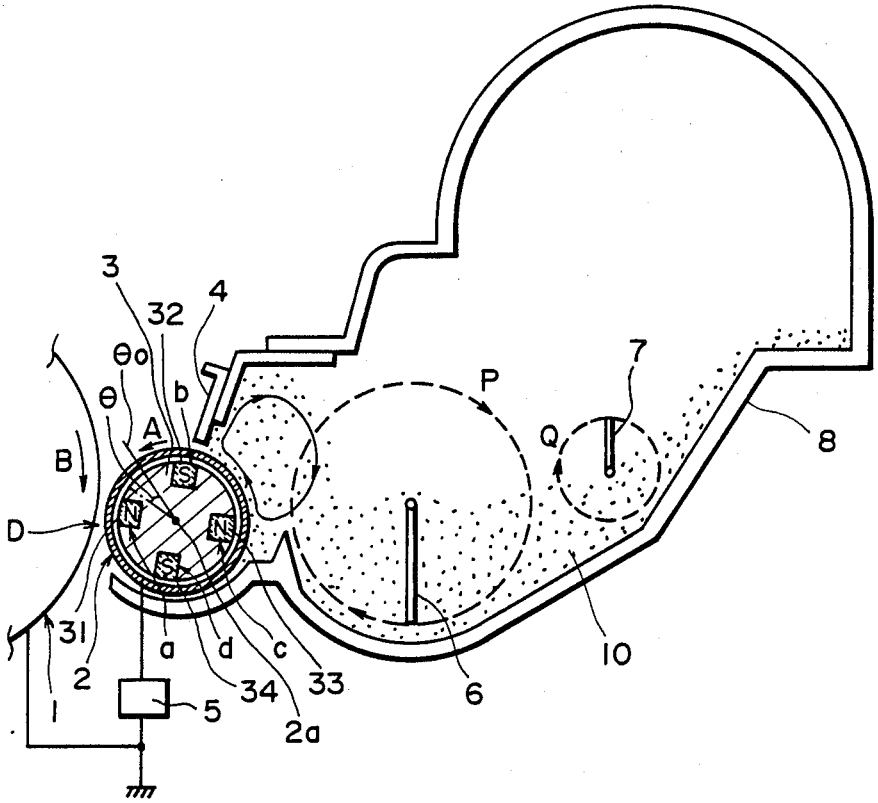
FIG. 3 is a sectional view of a developing apparatus according to an embodiment of the present invention.

Referring to FIG. 3, there is shown a developing apparatus according to an embodiment of the present invention, wherein an electrophotographic photosensitive drum 1 is rotatable in the direction indicated by an arrow B. An electrostatic latent image formed on the drum 1 is carried into a developing zone D wherein the photosensitive drum 1 and a cylindrical non-magnetic sleeve 2 made of aluminum or stainless steel or the like are opposed with a fine clearance. The sleeve 2 rotates in the direction A. Therefore, the drum 1 and the sleeve 2 rotate in the same peripheral movement directions in the developing zone D. The sleeve 2 carries the developer to bring it into the developing zone. The developer is supplied to the photosensitive drum 1 in the developing zone D.

In a developer container 8 in which the sleeve 2 is rotatably supported, one component magnetic developer (magnetic toner) 10 is contained. A stirring rod 6 rotates in a direction P to supply the developer 10 toward the developing sleeve 2. An auxiliary stirring rod 7 rotates in a direction Q to supply the developer toward the stirring rod 6.

The developer supplied to the sleeve 2 is attracted on the surface of the sleeve 2 by the magnetic force provided by the magnet 3 fixed within the sleeve 2. The magnet 3, in the shown example, has four magnet portions a, b, c and d. One magnetic pole shown in the Figure by references N and S of each of the magnet portions is disposed at its outer portion thereof. Magnetic pole 31 is a developing magnetic pole disposed opposed to the developing zone D; a magnetic pole 32 is a developer layer thickness regulated magnetic pole disposed opposed to a magnetic blade 4 made of steel or the like for regulating the layer thickness of the developer; and magnetic poles 33 and 34 are developer carrying magnetic poles.

To the magnetic blade 4, the magnetic field is concentrated from the magnetic pole 32, by which a thin layer of the magnetic developer 10 is formed on the sleeve (U.S. Pat. No. 4,387,664). The developer layer formed on the developing sleeve 2 has a thickness in the developing zone D, which is smaller than the clearance between the drum 1 and the sleeve 2. As for the means for forming the thin layer of the developer on the sleeve 2, an elastic blade contacted to the sleeve 2 is usable as disclosed in U.S. Pat. No. 4,458,627. In place of the magnetic blade 4, a non-magnetic blade is usable.

In the developing zone D, the developer is formed into a brush on the surface of the sleeve 2 by the perpendicular component of the magnetic field provided by the magnetic pole 31 (magnetic brush). In the developing zone D, the developer is released from the sleeve 2 surface and is deposited onto the drum 1 to develop the electrostatic latent image. To assist the releasing and the deposition, it is preferable that the sleeve 2 is supplied by a power source 5 with a DC bias voltage (preferably, a voltage between a light portion potential which is a potential of the latent image exposed to light and a dark portion potential which is a potential of the electrostatic latent image not exposed to light). For a further improvement of the image quality, an alternating bias voltage is applied to the sleeve 2 by the power source 5 to form a vibrating electric field into developing zone D. In the vibrating electric field, the developer is repeatedly deposited and released from the drum 1, so as to finally produce a high quality image (U.S. Pat. No. 4,292,387). The AC bias voltage preferably includes a DC voltage component between the light portion potential and the dark portion potential.

Figure 4:
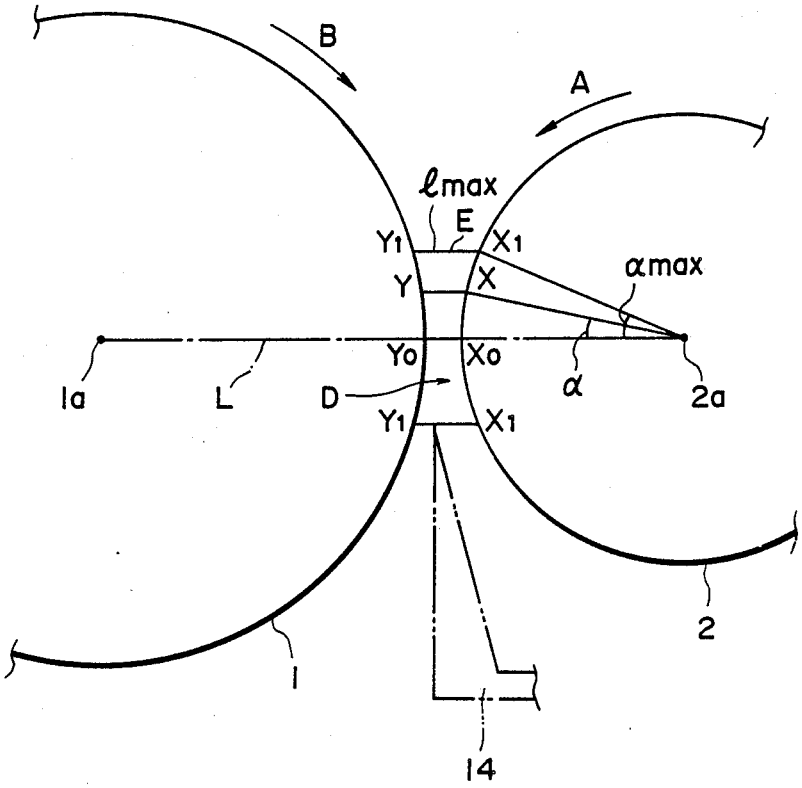
FIG. 4 is a sectional view illustrating a developing zone.

Referring to FIG. 4, a reference line L is defined as a line connecting between a rotational center 2*a* of the developing sleeve 2 and a rotational center 1*a* of the photosensitive drum 1, and a point X is defined as a point on the developing sleeve 2. Points X0 and Y0 are intersection between the reference line L and an outer periphery of the developing sleeve 2 and between the reference line L and the outer periphery of the photosensitive drum 1, respectively. The distance between the points X0 and Y0 is the minimum distance between the developing sleeve 2 and the photosensitive drum 1, and therefore, the point X0 is substantially at the center of the developing zone.

A distance lmax is defined as a maximum distance between the developing sleeve 2 and the photosensitive drum 1 which is a limit of developing the electrostatic latent image on the photosensitive drum 1 by the developer on the developing sleeve 2.

A line X1Y1 is defined as a line which is parallel to the line X0Y0 and which has a length equal to lmax and which connects the surfaces of the developing sleeve 2 and the photosensitive member 1. The line X1Y1, as shown in FIG. 4, exists at two positions interposing the point X0. In the developable zone, they are maximum distances between the opposing developing sleeve 2 and the photosensitive drum 1. Thus, the peripheral range defined by the two lines X1Y1 and X1Y2 can be defined as the developing zone D. The value of lmax is different depending on design conditions such as magnetic field strength or the like, and therefore, the maximum range (circumferential range) defined as the developing zone is different, correspondingly. The inventors' experiments have revealed that lmax $\leqq$2000 microns. An angle $\alpha$ is formed between the reference line L and a line connecting an arbitrary position X on the outer periphery of the developing sleeve 2 shown in FIG. 4 and the rotational center 2*a* of the developing sleeve 2. An angle $\alpha$max is formed therebetween when the position X is position X1. Therefore, the developing zone D is defined by angle $\alpha$ as a region wherein the angle $\alpha$ is not more than $|\alpha\max|$.

Figure 5:
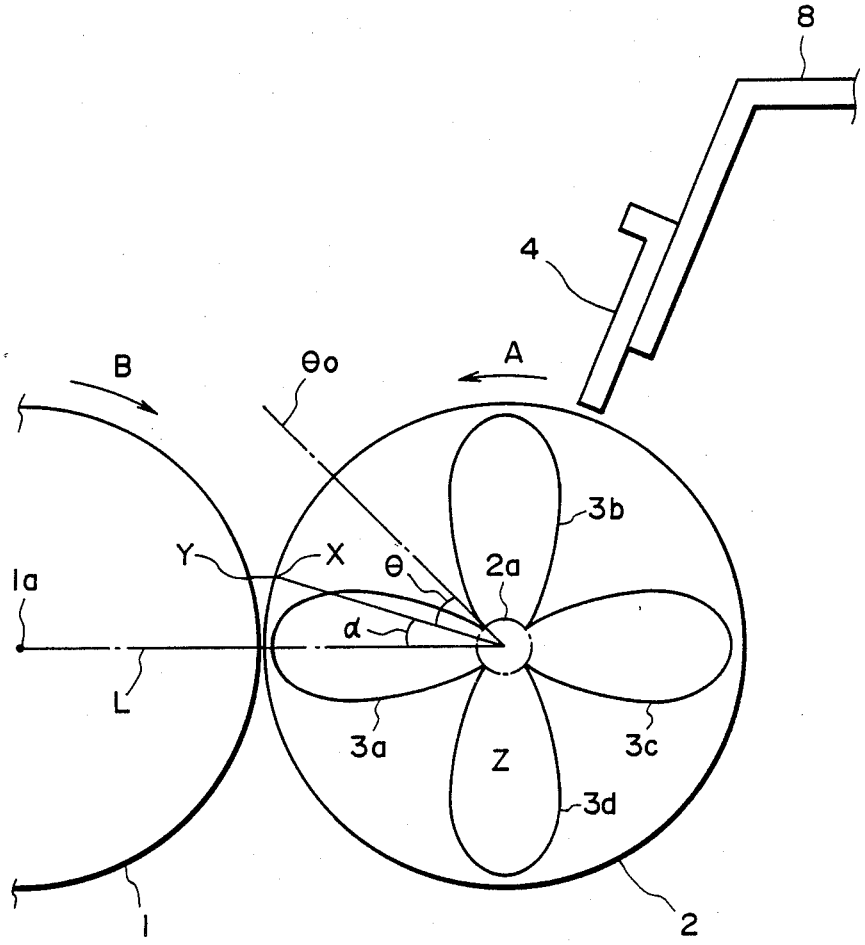
FIG. 5 shows a strength distribution of a perpendicular component of the magnetic field.

FIG. 5 is a distribution of the magnetic field strength, that is, the magnetic field density on the outer surface of the sleeve 2 on polar coordinates with its origin coincident with the rotational center 2*a* of the sleeve 2 the plots indicate magnetic flux densities at the angular positions as radial distances. A circle Z designates 0 Gauss. Curves 3*a*, 3*b*, 3*c* and 3*d* indicate strength distributions of the perpendicular magnetic field component corresponding to the magnetic poles 31, 32, 33 and 34, respectively.

As shown in FIG. 5, a position where the perpendicular magnetic field component by the magnetic pole 31 takes its maximum level, that is, the center of the magnetic pole 31 is disposed on or adjacent the line L. The strength of the perpendicular magnetic field component decreases from the maximum point toward upstream and toward downstream with respect to the rotational direction of the sleeve. The position where the perpendicular magnetic field component corresponding to the magnetic pole 31 is maximum is within the developing zone D.

Figure 6:
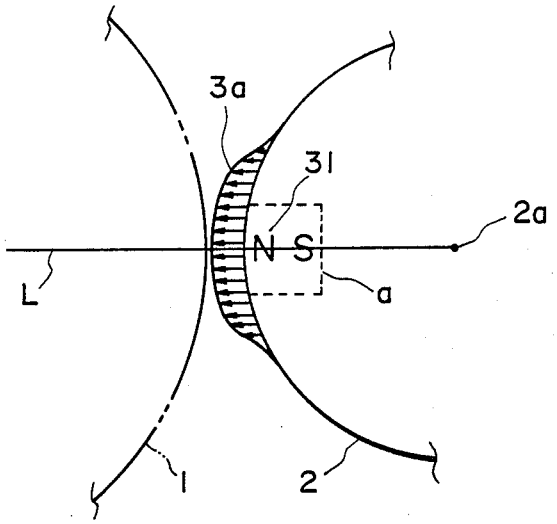
FIG. 6 shows another example of the strength distribution of the perpendicular component of the magnetic field.

FIG. 6 schematically shows a strength distribution of the perpendicular component of the magnetic field corresponding to the magnetic pole 31 on an outer periphery of the sleeve by arrows parallel to the line L having a length indicating the magnetic field strengths.

It has been found that production of the "tails" and "scattered spots" is attributable to a gradually changing inclination of the brush of the developer on the sleeve, or gradually changing erection. The degree of the inclination or erection of the brush of the developer corresponds to the change ratio of the strength of the perpendicular magnetic field component. This is because the perpendicular magnetic field component is contributable to the erection of the developer brush on the sleeve.

Figure 7:
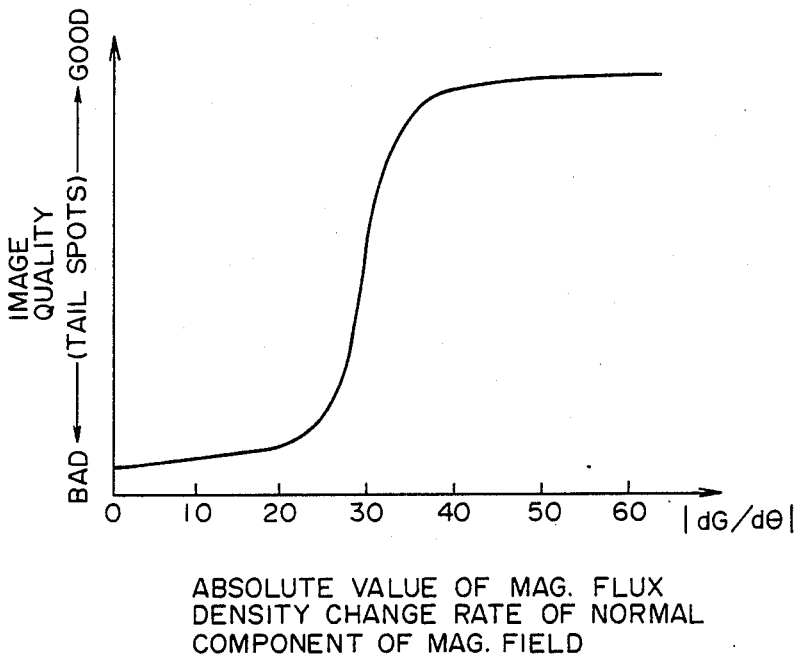
FIG. 7 is a graph showing the relation between an image quality and a changing rate of magnetic flux density of the perpendicular component of the magnetic field.

It has been found that, as shown in FIG. 7, the tails and scattered spots are significantly produced with the result of the degraded quality of the image, if a change rate of the strength (magnetic flux density) of a perpendicular component of the magnetic field on the sleeve surface per unit angle seen from the rotational center of the sleeve is smaller than 30 Gausses per degree.

In consideration of this, an absolute value of the change rate of the perpendicular component of the magnetic field corresponding to the magnetic pole 31 is such as to have a maximum and such that the maximum level is not less than 30 Gausses per degree, by which the developer abruptly erects or inclines on the sleeve at a position adjacent the maximum level positions, so that the resultant image is substantially free from the tails and scattered spots, as shown in FIG. 1B.

The magnetic flux density distribution of the perpendicular magnetic field component provided by the developing magnetic pole 31 will be further described.

Figure 8:
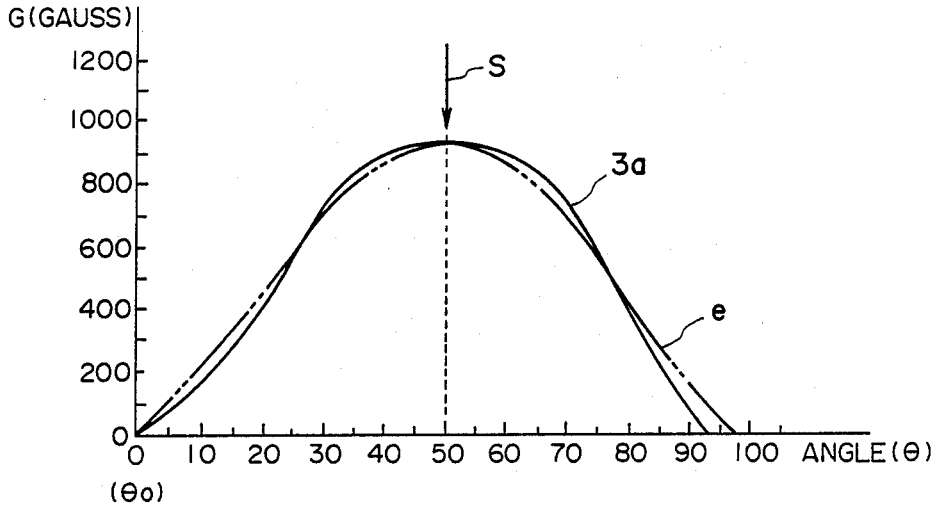
FIG. 8 is a graph showing a perpendicular component distribution of the magnetic field on the developing sleeve surface.

Referring to FIG. 8, the magnetic flux density distributions of the perpendicular magnetic field components are shown, one for the developing magnetic pole in an embodiment of the present invention by a solid line *3a*, the other for a conventional developing pole by a chain line e. On the axis of the abscissa, a reference position ($\theta_0=0$) is a position which is between the magnetic pole 31 and a magnetic pole 32 disposed upstream thereof with respect to a rotational direction A of the developing sleeve 2 and at which the density of the perpendicular magnetic field component provided by the magnetic pole 31, and the angular position $\theta$ is an angle therefrom measured toward downstream, as seen from the rotational center *2a* of the developing sleeve 2. The ordinate position indicates the magnetic flux density G (Gauss) of the perpendicular magnetic field component on the surface of the developing sleeve 2. When the embodiment of the present invention and the conventional apparatus are compared in this figure, the density is flatter in the embodiment (solid line *3a*) than in the conventional apparatus (chain line e) adjacent a maximum magnetic flux density point S at the center of the magnetic pole (angular position $\theta$=approx. 50 degrees). In addition, it changes more steeply in the embodiment than in the conventional apparatus at positions away from the central position S by a predetermined distance toward each side.

Figure 9:
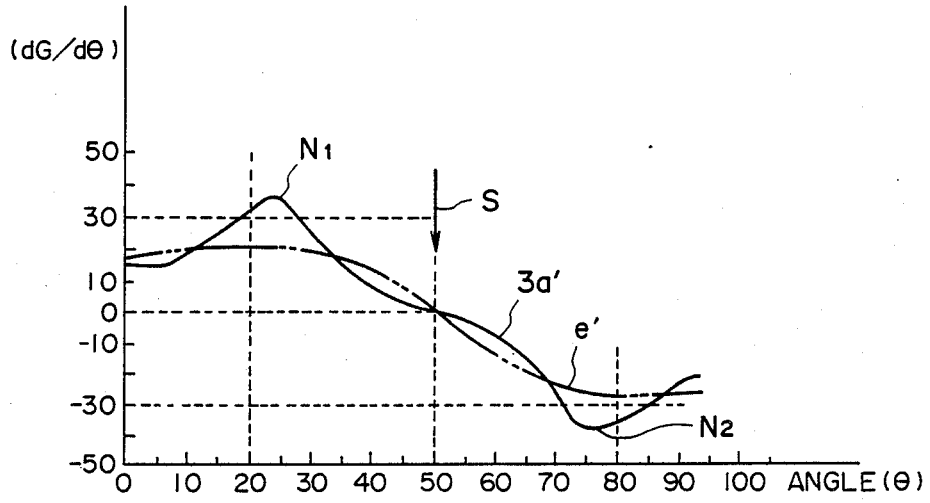
FIG. 9 is a graph showing differential of the distribution shown in FIG. 8.

FIG. 9 is a graph produced, in order to further clarify the above, by differentiating the magnetic flux density G (Gauss) of the perpendicular magnetic field component indicated in FIG. 8 with the angle $\theta$, and the differentiation by the angle $\theta$ (change rate) is plotted on the graph of FIG. 9, curve *3a'* indicates a change rate of the curve *3a;* and a curve e' indicates a change rate of the curve e.

When those curves are compared, it is clearly understood that the change rate is larger, and a local maximum portion N1 and local minimum portion N2 (local maximum if the absolute value thereof is considered) are sharper at positions away from the central position S toward both sides by predetermined distances. In addition, the maximum value N1 and an absolute value |N2| of the minimum value N2 are both larger than 30 Gausses per degree. Therefore, as shown in FIG. 2B, the brush of the developer is abruptly erected on the sleeve 2 adjacent the positions N1 and N2. In other words, the brush abruptly inclines on the sleeve 2 at the outsides of the erected region. Therefore, the boundaries between the region wherein the brush is erected on the sleeve 2 and the region wherein the brush is inclined along the surface of the sleeve 2 by the tangential magnetic field component becomes relatively more discrete. The developer in the region where the brush is inclined along the surface of the sleeve is confined from motion toward the photosensitive drum, and therefore, in the state shown in FIG. 2B, it is difficult for the developer to transfer to the photosensitive drum in the region upstream of the point N1 and in the region downstream of the point N2 with respect to the rotational direction of the sleeve. On the other hand, in the region between the points N1 and N2, the brush of the developer is erected from the sleeve 2 with a relatively large angle, that is, approximately perpendicular to the sleeve, and therefore, the individual particles of the developer are arranged in good order, so that it is easy for the developer in this region to move to the photosensitive drum 1 with confined movement and deposition resulting in the tails and the scattered spots.

It is preferable that the point N1 is away from the center of the developing zone D toward the inlet side, more particularly is adjacent an inlet region of the developing zone D, in other words, adjacent an upstream end of the developing zone D with respect to the rotational direction of the sleeve; and/or that the point N2 is away from the center of the developing zone D toward the outlet side, more preferably is adjacent an outlet side end F of the developing zone D, in other words, adjacent a downstream end of the developing zone D with respect to the rotational direction of the sleeve. From the standpoint of preventing the tails and scattered spots, good results are obtained by placing the point N1 within 1 mm from the inlet side end E of the developing zone D toward upstream and downstream, and/or by placing the point N2 within 1 mm from the outlet end F of the developing zone D toward upstream and downstream, with respect to the rotational direction of the sleeve.

It is preferable that the points N1 and N2 are disposed within 30 degrees from the center S of the magnetic pole 31 toward upstream and downstream with respect to the rotational direction of the sleeve. As described hereinbefore, in order to release the developer from the sleeve and deposit it to the photosensitive drum, it is generally preferable that the clearance between the drum and the sleeve is not more than 2000 microns, and therefore, it is preferable that both of the points N1 and N2 are within the region wherein the clearance between the photosensitive drum and the sleeve is not more than 2000 microns.

It is more difficult for the developer adjacent the inlet side of the developing zone to be transferred to the photosensitive drum than for the developer adjacent the outlet side to transfer to the photosensitive drum.

Therefore, even if the developer is in the state shown in FIG. 2A adjacent the inlet side, the tails and scattered spots attributable to the developer is relatively insignificant. In consideration of this, the magnet may be magnetized such that the maximum (not less than 30 Gausses are degree) of the absolute value of the change rate of the perpendicular component magnetic field strength exists only adjacent the outlet side end F of the developing zone D. In this case, adjacent the inlet end of the developing zone D, the brush of the developer is as shown in FIG. 2A, whereas adjacent the outlet end, the brush is as shown in FIG. 2B.

Another embodiment of the present invention will be described wherein an isolation plate is disposed between the developing sleeve 2 and the photosensitive drum 1. Since the apparatus of this embodiment is similar to the above-described embodiment, the apparatus of this embodiment is shown in FIG. 4 with the isolation plate 14 indicated by chain lines, and the description of the other respects is omitted for simplicity. In the present embodiment, in order to prevent the developer brushes inclined adjacent both ends of the developing zone from being involved in the development action, the isolating plate 14 is provided. The isolating plate 14 is extended in the longitudinal direction of the developing sleeve 2 between the developing sleeve 2 and the photosensitive member 1 such that at least the lateral edge thereof is within the region X1X1. The material may be selected depending on the properties of the developer and the parts therearound, from non-magnetic, magnetic, electrically insulative, electrically conductive or other materials. As regards the configuration, it may have a wedged end as shown in FIG. 4, or it may be rectangular. When the edge of the isolating plate 14 is disposed adjacent the outlet end F of the developing zone, a polyethylene terephthalate plate or a stainless steel plate having a thickness of 5–1500 microns at its base portion when 1max=2000 microns, for example. In FIG. 4, the isolating plate 14 is provided only at an outlet end portion F, but it is possible that it is provided only at the inlet end E. It may be provided at each end. In the present embodiment described above, the unintended developing action by the inclined brush at the ends of the developing zone can be further prevented.

As for the magnet usable with the present invention, it may be of a bonded type, embedded type, ferrite-sintered type, magnetic particle containing resin type integrally formed, or the like is usable. Particularly, an integrally formed resin type is advantageous in the low cost, light weight and in that it is possible to provide a small diameter magnet. The magnetization of the developing magnetic pole is not necessarily limited to a symmetrical arrangement having a symmetrical center of the maximum magnetic flux density point in the strength distribution of the perpendicular magnetic field, but it may be asymmetrical or may be deformed.

The present invention is applicable also to a developing apparatus wherein two component developer containing magnetic carrier particles and toner is used.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an image bearing member, comprising:

a rotatable developer carrying member faced to the image bearing member in a developing zone, for carrying a developer having a magnetic property and for carrying it to the developing zone;

a developer regulating member for regulating a layer of the developer on said developer carrying member to a thickness smaller than a minimum clearance between the image bearing member and the developer carrying member in the developing zone;

a magnet stationarily disposed in said developer carrying member, said magnet having a magnetic pole for erecting a brush of the developer on said developer carrying member in the developing zone, wherein a position where an absolute value of a change rate of a perpendicular component of a magnetic field on a surface of said developer carrying member with respect to a rotational direction of said developer carrying member takes a local maximum is adjacent an outlet end of the developing zone, and wherein the local maximum is not less than 30 Gausses per degree.

2. A developing apparatus for developing an electrostatic latent image formed on an image bearing member, comprising:

a rotatable developer carrying member faced to the image bearing member in a developing zone, for carrying a developer having a magnetic property and for carrying it to the developing zone;

a developer regulating member for regulating a layer of the developer on said developer carrying member to a thickness smaller than a minimum clearance between the image bearing member and the developer carrying member in the developing zone;

a magnet stationarily disposed in said developer carrying member, said magnet having a magnetic pole for erecting a brush of the developer on said developer carrying member in the developing zone, wherein an absolute value of a change rate of a perpendicular component of a magnetic field on a surface of said developer carrying member with respect to a rotational movement direction of said developer carrying member takes a first local maximum adjacent an inlet side of the developing zone and takes a second local maximum adjacent an outlet side of the developing zone, and wherein the first and second maximums are not less than 30 Gausses per degree.

3. A developing apparatus for developing an electrostatic latent image formed on an image bearing drum, comprising:

a rotatable developer carrying cylinder faced to the image bearing drum in a developing zone, for carrying a developer having a magnetic property into the developing zone;

developer layer forming means for forming on said developer carrying cylinder a layer of developer having a thickness smaller than a minimum clearance between the image bearing drum and said developer supporting cylinder in the developing zone; and a magnet stationarily disposed in said developer carrying cylinder, said magnet having a magnetic pole for erecting a brush of the developer on said developer carrying cylinder in the developing zone, said magnetic pole forming a magnetic field having a local maximum, not less than 30 Gausses per degree, of an absolute value of a change rate of a perpendicular component of a magnetic field on a surface of said carrying cylinder with respect to a rotational direction of the cylinder.

4. An apparatus according to claim 3, wherein a position of the local maximum is downstream of a center of the magnetic pole with respect to the rotational direction of said developer carrying cylinder.

5. An apparatus according to claim 4, wherein a strength of the perpendicular component of the magnetic field provided by the magnetic pole decreases downstream from the center of the magnetic pole with respect to the rotational direction thereof.

6. An apparatus according to claim 4, wherein the magnetic field has a second local maximum not less than 30 Gausses per degree, of the absolute value at a position upstream of the center of the magnetic pole with respect to the rotational direction.

7. An apparatus according to claim 6, wherein a strength of the perpendicular component of the magnetic field provided by the magnetic pole decreases upstream and downstream from the center of the magnetic pole with respect to the rotational direction.

8. An apparatus according to claim 1 or 2, comprising means for applying an alternating bias voltage to said developer carrying member.

9. An apparatus according to any one of claims 3–7, further comprising means for applying an alternating bias voltage to said developer carrying cylinder.

10. An apparatus according to claim 1 or 2, further comprising means for applying a DC bias voltage to said developer carrying member.

11. An apparatus according to any one of claims 3–7, further comprising means for applying a DC bias voltage to said developer carrying cylinder.

12. A developing apparatus for developing an electrostatic latent image formed on an image bearing member, comprising:

a rotatable developer carrying member faced to the image bearing member in a developing zone, for carrying a developer having a magnetic property and for carrying it to the developing zone;

a developer regulating member for regulating a layer of the developer on said developer carrying member to a thickness smaller than a minimum clearance between the image bearing member and the developer carrying member in the developing zone;

a magnet stationarily disposed in said developer carrying member, said magnet having a magnetic pole for erecting a brush of the developer on said developer carrying member in the developing zone, wherein a position where an absolute value of a change rate of a perpendicular component of a magnetic field on a surface of said developer carrying member with respect to a rotational direction of said developer carrying member takes a local maximum is deviated toward an outlet side from a center of the developing zone.

13. A developing apparatus for developing an electrostatic latent image formed on an image bearing member, comprising:

a rotatable developer carrying member faced to the image bearing member in a developing zone, for carrying a developer having a magnetic property and for carrying it to the developing zone;

a developer regulating member for regulating a layer of the developer on said developer carrying member to a thickness smaller than a minimum clearance between the image bearing member and the developer carrying member in the developing zone;

a magnet stationarily disposed in said developer carrying member, said magnet having a magnetic pole for erecting a brush of the developer on said developer carrying member in the developing zone, wherein an absolute value of a change rate of a perpendicular component of a magnetic field on a surface of said developer carrying member with respect to a rotational movement direction of said developer carrying member takes a first local maximum at an inlet side of the developing zone and takes a second local maximum at an outlet side of the developing zone, and wherein the first and second maximums are not less than 30 Gausses per degree.

* * * * *

UNITED STATES PATENT AND TRADEMARK OFFICE

CERTIFICATE OF CORRECTION

PATENT NO. : 4,941,019

DATED : July 10, 1990

INVENTOR(S) : TAKAO HONDA, ET AL.

It is certified that error appears in the above-identified patent and that said Letters Patent is hereby corrected as shown below:

IN [57] ABSTRACT

Line 3, "a" (second occurrence) should read --an--.
Line 5, "is" should read --are--.

COLUMN 8

Line 13, "zone;" should read --zone; and--.
Line 38, "zone;" should read --zone; and--.

COLUMN 10

Line 6, "zone;" should read --zone; and--.
Line 30, "zone;" should read --zone; and--.

Signed and Sealed this

Seventh Day of July, 1992

*Attest:*

DOUGLAS B. COMER

*Attesting Officer*

*Acting Commissioner of Patents and Trademarks*